United States Patent [19]

Mackey

[11] 4,298,999

[45] Nov. 10, 1981

[54] WOMEN'S PROTECTIVE KEY RING

[76] Inventor: Maureen E. Mackey, 524 Amherst Dr., S.E., Albuquerque, N. Mex. 87106

[21] Appl. No.: 159,160

[22] Filed: Jun. 13, 1980

[51] Int. Cl.[3] ..... A44B 15/00

[52] U.S. Cl. ..... 7/170; 70/456 R

[58] Field of Search ..... 70/456 R, 458; 7/170, 7/167; 30/295, 298, 340; 273/84 R; D3/61, 62

[56] References Cited

U.S. PATENT DOCUMENTS

| | | | |
|---|---|---|---|
| 1,766,599 | 6/1930 | Cahill | 70/456 R X |
| 2,219,413 | 10/1940 | Dellar | 30/295 X |
| 3,865,370 | 2/1975 | Rogers | 30/340 X |
| 4,160,369 | 7/1979 | Pearson | 70/456 R |
| 4,191,038 | 3/1980 | Vaughn | 70/458 |

*Primary Examiner*—Jimmy C. Peters

*Attorney, Agent, or Firm*—Robert W. Harris

[57] ABSTRACT

A women's protective key ring, intended for carrying keys and for use for defensive purposes in the event of an unexpected attack, having a handle which can be grasped with the entire hand of the owner, and an ornament-striker attached to the handle so as to cover the front of the owner's fist when the handle is grasped.

11 Claims, 3 Drawing Figures

WOMEN'S PROTECTIVE KEY RING

BACKGROUND OF THE INVENTION

The invention pertains to a key ring of novel configuration which could be useful as a defensive weapon for a person subjected to an unexpected attack, particularly when approaching or leaving an automobile in an unattended place at night, or when approaching or leaving the doorway of an apartment, residence or business, whether on the street, in a hallway or in an elevator.

As a result of the increasing incidence of violent crimes in the United States in recent years, there has been a great proliferation of personal protective devices intended for use particularly by women who may be subject to unexpected physical assaults. Women who work or shop during night and even daytime hours have often been subjected to such attacks in unattended parking lots, or when approaching or leaving the doorways of their residences.

Many personal protective devices have been marketed which either emit tear gas to be directed into the face of the attacker, or which emit high intensity sound intended to bring aid from passers-by, and frighten away the attacker.

However such devices may be of no use to the victim in the case of a sudden unexpected attack, unless she happens to have the device in hand, since there may not be time to retrieve the device from a handbag or coat pocket.

Also a sound emitting device may offer no protection in the case of an attack in a deserted location, where the attacker knows that there are no other persons in the vicinity.

One advantage of the present invention in relation to other personal protection devices is that a woman approaching or leaving her automobile, or approaching or leaving a building, will naturally tend to have the key ring in hand and instantly available, rather than in her handbag or coat pocket.

Another advantage is that applicant's key ring may be fashioned in an attractive form, and use of the key ring would not be discouraged by any feelings of self-consciousness which might prevent a woman from regularly carrying a canister of tear gas in her hand as she approached or exited her automobile, residence or apartment elevator.

Applicant is aware of various forms of key rings disclosed in the following U.S. Pat. Nos. known to applicant: Barrett (3,604,233), Merrill (803,839), Weihman (Des. 34,370), Fischer (Des. 128,625), Imhoff (2,292,563), Leopoldi (3,126,729) and Kamp (3,589,155).

However none of these patents disclose key rings of a form very similar to that of applicant. The key rings disclosed in the patents of Weihman and Merrill appear to be the least dissimilar in form. The key rings of Weihman and Merrill lack the ornament-striker of applicant's key ring, described below. Moreover none of these patents states dimensions indicating a key ring of sufficient size to place four fingers through the ring, as in the present invention (and FIG. 3 of the patent of Imhoff indicates a key ring large enough for only one finger). None of the patents makes a statement about placing four fingers through the key ring, and none makes any statement suggesting a defensive use of the key ring, as with the present invention.

SUMMARY OF THE INVENTION

The present invention is a key ring having a handle of such form and size as to be readily grasped with the entire hand of the owner, with an ornament-striker attached to the handle so as to cover the front of the fist of the owner when the handle is grasped. The ornament-striker may be used to strike a blow against an attacker, but is also ornamental, although the precise form of the ornamental design is of no consequence for purposes of the invention. However the design should be attractive, giving the appearance of ornamental jewelry, rather than the appearance of a defensive weapon.

One object of the invention is to provide a key ring of such form that the owner may use the key ring as a defensive weapon in the event of an unexpected attack.

Another object of the invention is the provision of a personal protective device which the owner will naturally tend to have in hand when approaching or leaving her automobile, residence or place of business.

Another object of the invention is the provision of a personal protective device which is also attractive and useful for normal purposes, so that the invention will likely be instantly available when suddenly needed in the event of an unexpected attack against the owner.

DESCRIPTION OF THE PREFERRED EMBODIMENTS

Figure 3:
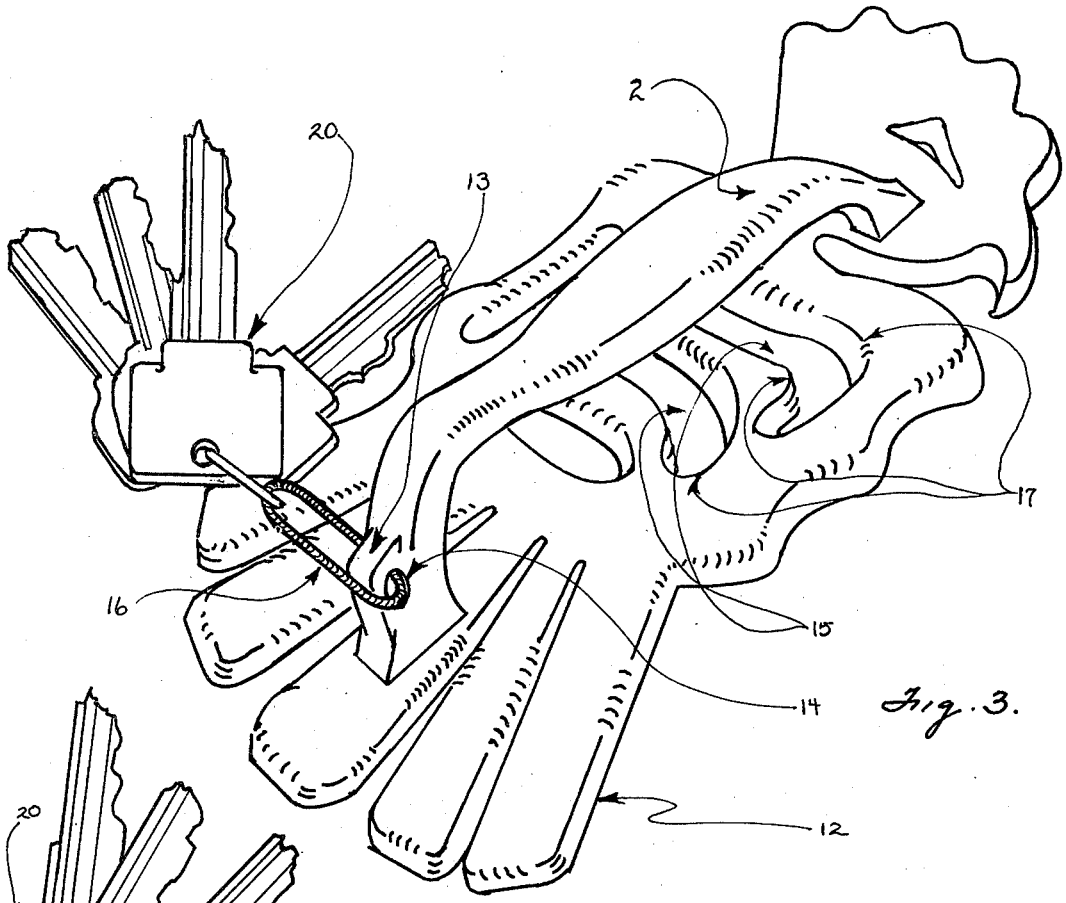
FIG. 3 is a perspective view of the same embodiment of the present invention.
Figure 1:
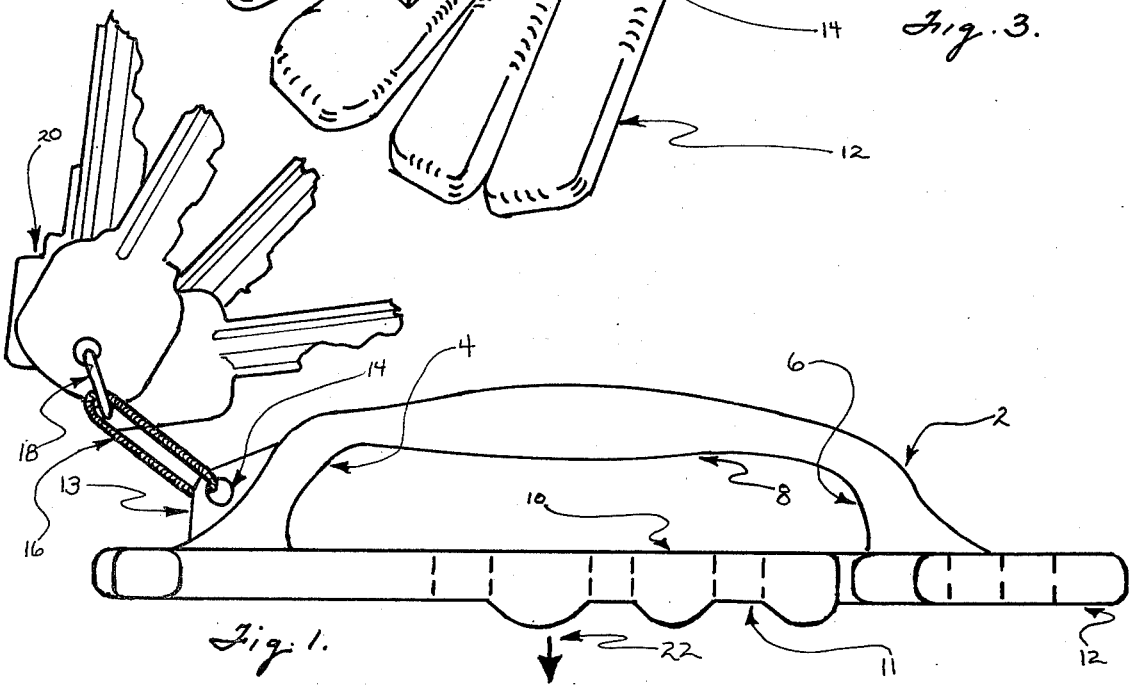
FIG. 1 is a side elevational view of one embodiment of the present invention.
Figure 2:
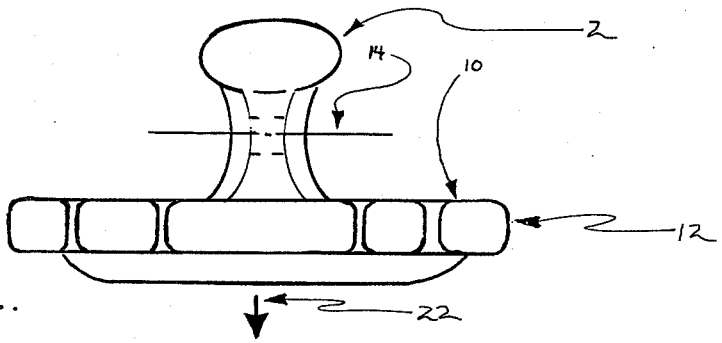
FIG. 2 is an end elevational view of the same embodiment, as viewed from the left in FIG. 1, in which view items 16, 18 and 20 are omitted.

Referring now to FIGS. 1, 2 and 3 of the drawing, wherein like reference numbers denote like or corresponding parts, the handle 2 is of such size and form as to be readily grasped by the entire hand of the owner. The length of the inner grasping surface 8 of the handle 2, between the inner end 4 and the other inner end 6 of the handle 2, accordingly just exceeds the width of the four fingers of the owner's hand.

The inside aperture of the handle 2, namely the distance between the inner grasping surface 8 of the handle 2 and the inner surface 10 of the ornament-striker 12 (hereinafter "finger aperture"), is just sufficient to allow the owner to easily insert the four fingers of one hand through the key ring so as to firmly grasp the handle 2, with the front of the owner's fist resting in contact with the inner surface 10 of the ornament-striker 12. In one specific embodiment of the invention the finger aperture is $\frac{3}{4}''$, the inside length of the handle 2 is $2\frac{5}{8}''$, the length of the ornament-striker 12 is $4\frac{1}{2}''$, the overall length of the handle 2 is $3\frac{1}{4}''$ and the total height (from the outer surface 11 of the ornament-striker 12 to the opposite side of the handle 2) is $1\frac{1}{4}''$.

The owner uses the key ring for defensive purposes by securely grasping the key ring by the handle 2 and directing a blow against an attacker with the outer surface 11 of the ornament-striker 12, in the direction 22.

The inner surface 10 of the ornament-striker 12 is smooth and essentially flat, since the knuckles and the adjacent section of each of the four fingers of the owner's hand are in contact with said surface. When the owner strikes a blow in the direction 22, and encounters a hard surface, such the head of an attacker, the force of the blow will be transmitted to the owner's hand at two principal locations. Part of the force will be transmitted to the knuckles and the adjacent section of each of the fingers, from the inner surface 10 of the ornament-striker 12. The other part of said force will be transmitted to the palm of the hand by the handle 2. In this manner the force of the blow is divided between different portions of the owner's hand, and is less likely to injure the hand, than if absorbed in only one portion of the hand.

In one embodiment of the invention the ornament-striker 12 has holes 15 forming an ornamental design, and in this embodiment the inner edges 17 of the holes 15 on the inner surface 10 of the ornament-striker 12, are rounded for protection of the hand of the owner.

Protection of the owner's hand can be enhanced by bonding a thin layer of rubber or other elastic material to the inner surface 10 of the ornament-striker 12, so as to cushion the force of the blow transmitted to the owner's hand. Such a material could also be bonded to the surface of the handle 2. Such elastic material could be bonded to these metal surfaces with an appropriate adhesive material, in a manner well-known in the art.

The surface of the handle 2 and the inner surface 10 of the ornament-striker 12 can also be made with slight indentations corresponding to the shape of the fingers of the owner. This will assist the owner in securely grasping the key ring, and more uniformly distribute the force of a blow to the owner's hand.

The ornament-striker 12 is in the preferred embodiment a heavy, ornamental metal member of length just exceeding the overall length of the handle "2", and width just exceeding the length of each of the sections of the owner's fingers adjacent to the knuckles. Thus, the ornament-striker 12 completely covers the front of the fist of the owner when the owner grasps the handle 2. The thickness of the ornament-striker 12 is considerably less than its length and width, so as to avoid unnecessary weight.

Although the inner surface 10 of the ornament-striker 12 is essentially flat for the protection of the owner's hand, the outer surface 11 of the ornament-striker 12 will, in general, not be flat, depending upon the particular ornamental design used.

The surface irregularities in the design of the outer surface 11 of the ornament-striker 12 may enhance the stunning effect of a blow directed to the head of an attacker, and also may leave a scar in the form of the design, which could be useful to the police in later identifying the attacker.

It will be appreciated by those skilled in the art that the applicant's invention is not limited to key rings utilizing any *particular* ornamental design for the ornament-striker 12, since the particular design is immaterial to the defensive use of the key ring, or to the use for carrying keys.

The handle 2 has a boss 13 at one end having a hole 14, which is used to attach a thin chain 16 to the handle 2. A ring 18 secures keys 20 to the thin chain 18. Of course, a ring 18 could be passed through the hole 14 in the boss 13 so as to secure keys 20 to the handle 2 without use of the thin chain 16. In the preferred embodiment, the handle 2 with its boss 13 and hole 14, the thin chain 16, and the ring 18 together constitute the means for securing keys to applicant's key ring. However, it will be apparent to those skilled in the art that many other equivalent means could be used, without departing from the spirit of applicant's invention. For example the ring 18 could encircle one end of the handle 2, without use of a hole 14 in the boss 13. Or the keys could be attached through use of a chain or ring secured through a hole in the ornament-striker 12, rather than the hole 14 in the boss 13 of the handle 2.

In the preferred embodiment, the key ring is made from metal, by introducing molten metal into a mold formed through use of the lost wax process, while process is well known in the art. In this process, a piece of wax is fashioned into a full-scale model of the intended form of the key ring, in a manner well known in the art. A mold capable of withstanding high temperatures is then formed around the wax model of the key ring. Then the wax model is burned out of the mold, by placing the mold in a kiln, leaving a mold having a void in the form of the desired key ring. The mold is then placed in a centrifugal casting machine, which injects molten metal into the mold. After the molten metal has solidified, the mold is quenched in cold water until it breaks apart, allowing removal of the finished key ring. In this manner, the handle 2 and ornament-striker 12 may be formed of one piece of metal.

Although applicant's key ring is formed of metal in the preferred embodiment, it will be apparent to those skilled in the art that other materials of sufficient strength and density might be used instead. For example, suitable heavy plastic might be used, or the key ring could be carved from stone of suitable composition.

The invention may be embodied in other specific forms without departing from the essential characteristics thereof. The preferred embodiment is therefore to be considered as primarily illustrative and not restrictive, and all changes which come within the meaning and range of equivalency of the claims as construed in light of the specification are therefore intended to be embraced therein. The essential characteristics of the invention are defined in the appended claims.

I claim:

1. Key ring for holding in an owner's hand for defensive purposes and for holding keys, comprising:

(a) An ornament-striker, having an inner surface and an outer surface, having length and width roughly comparable to the length and width, respectively, of the front of the owner's clenched fist, said ornament-striker being essentially flat on the inner surface thereof;

(b) A handle of inside length exceeding the width of said owner's hand across four fingers, said handle being joined to said ornament-striker near each end of the inner surface thereof, the inside aperture of said handle just exceeding the thickness of said owner's fingers;

(c) Means, secured to said handle, for securing keys to said key ring.

2. The key ring of claim 1, wherein the length and width of said ornament-striker just exceed the length and width, respectively, of the front of the owner's clenched fist.

3. The key ring of claim 1, wherein the thickness of said ornament-striker is considerably less than the length and width of said ornament-striker.

4. The key ring of claim 1, wherein the inside surface of said ornament-striker bears small indentations corresponding to the shape of the fingers of said owner.

5. The key ring of claim 1, wherein the surface of said handle bears small indentations corresponding to the shape of the fingers of said owner.

6. The key ring of claim 1, wherein said ornament striker has a plurality of holes forming an ornamental design, the edges of said holes on said inner surface of said ornament-striker being rounded.

7. The key ring of claim 1, further comprising a thin layer of elastic material bonded to said inner surface of said ornament-striker.

8. The key ring of claim 1, further comprising a thin layer of elastic material bonded to the surface of said handle.

9. The key ring of claim 1, wherein said key ring is metal.

10. The key ring of claim 1, wherein said key ring is stone.

11. The key ring of claim 1, wherein said key ring is plastic.

* * * * *